United States Patent [19]

Müller

[11] 4,270,281

[45] Jun. 2, 1981

[54] COMBINED DRUM WASHER AND DRYING ARRANGEMENT

[75] Inventor: Franz Müller, Troisdorf, Fed. Rep. of Germany

[73] Assignee: August Lepper Maschinen- und Apparatebau GmbH, Bad Honnef, Fed. Rep. of Germany

[21] Appl. No.: 99,752

[22] Filed: Dec. 3, 1979

[30] Foreign Application Priority Data

Dec. 4, 1978 [DE] Fed. Rep. of Germany ..... 2852449

[51] Int. Cl.[3] ..... F26B 11/04

[52] U.S. Cl. ..... 34/75; 34/77; 34/133; 68/18 C

[58] Field of Search ..... 68/18 C, 20; 34/75, 34/77, 133, 32

[56] References Cited

U.S. PATENT DOCUMENTS

| | | | |
|---|---|---|---|
| 2,451,692 | 10/1948 | Pugh | 34/75 |
| 2,838,845 | 6/1958 | Erickson | 34/75 |
| 3,022,581 | 2/1962 | Smith | 34/75 |
| 3,040,440 | 6/1962 | Mellinger et al. | 34/75 |
| 4,112,590 | 9/1978 | Muller | 34/75 |

FOREIGN PATENT DOCUMENTS

| | | |
|---|---|---|
| 6600587 | 1/1969 | Fed. Rep. of Germany . |
| 2529577 | 2/1979 | Fed. Rep. of Germany . |

*Primary Examiner*—Larry I. Schwartz

*Attorney, Agent, or Firm*—Cushman, Darby & Cushman

[57] ABSTRACT

A washing and drying machine comprises a perforate drum 14 rotatable with a liquid container 11 having, in its upper portion, a recess 12 in which is disposed a heat-register or heating element 18 and a reflector 13 providing for direct irradiation of the drum 14. Drain opening 20 from the container 11 connects to a condensor arrangement 17 supplied with cold water 23 and an impeller in the form of a turbine 27 serves to recirculate air from the opening 20 back to a heat-exchange space 30 in the recess 12, between the heating element 18 and the container 11, from which it emerges by way of nozzles 31 along the periphery of the reflector 13.

6 Claims, 1 Drawing Figure

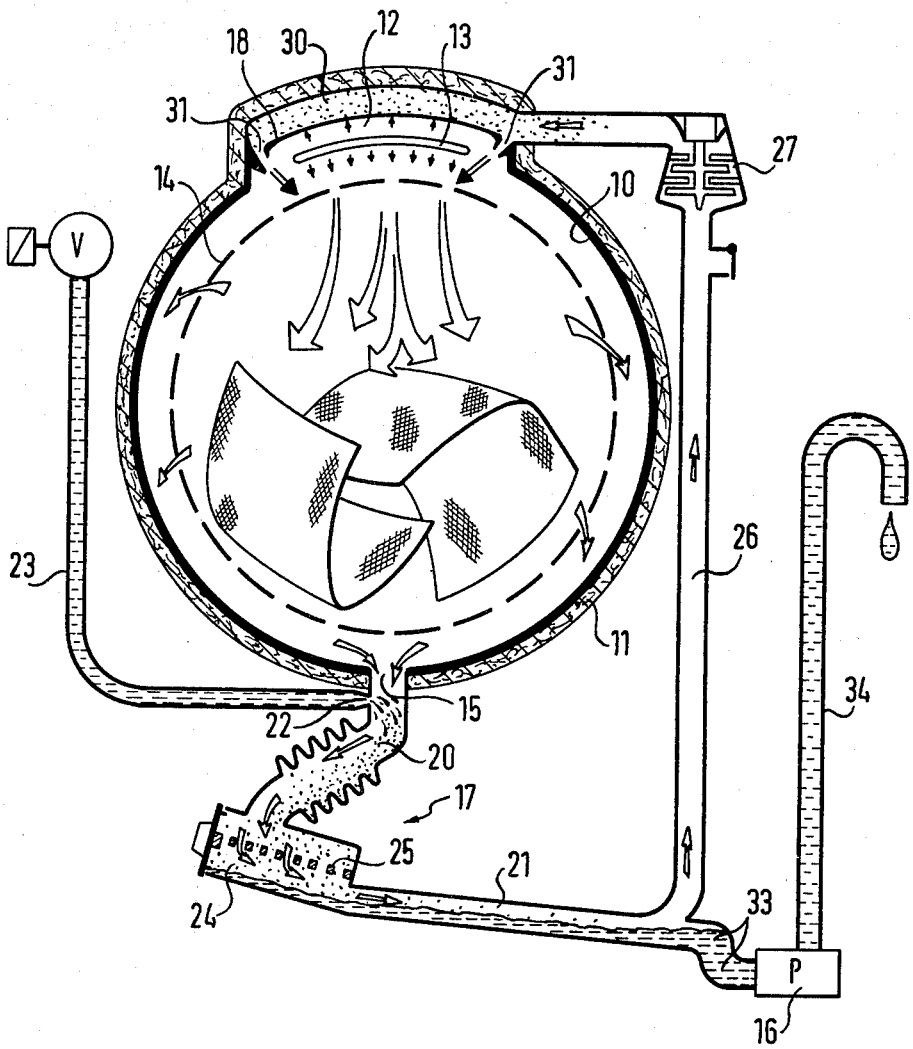
18
30
12
13
31
31
27
14
10
V
23
26
11
34
15
22
20
17
25
21
24
33
P
16

COMBINED DRUM WASHER AND DRYING ARRANGEMENT

This invention relates to a drum-type washing and drying machine having a heat register or heating element fitted in the upper part of a washing-liquid container in a recess in front of a reflector so as to provide for direct irradiation of a washing drum mounted within the container; a circulating-air conduit connecting with a drain-opening of the container and leading by way of a suction-pressure-turbine the pressure side of which opens into a heat-exchange space situated behind the reflector; and a condensor adapted to be supplied with cold water.

A drum-type washing and drying machine of this type is known from German Offenlegungschrift No. 25 29 577.6 in which circulating-air, led from the suction-pressure-turbine through the heat-exchange space behind a reflector and dried, is blown into a washing drum through a nozzle through a front loading-opening of the washing drum. For evaporating moisture from washing in the drum, the exterior of the washing drum is irradiated and warmed by a heat-register so that heat energy taken up by the material of the washing-drum, which is a good conductor of heat, is transmitted to the washing in the interior of the drum and evaporation is effected. With this design of drum-type washing and drying machine very good results are achievable, particularly with the drying process. However, the supply of dried circulating air through the front loading-opening of the washing drum involves a proportionately large expenditure of mechanical energy. Since the supply air is also heated in the heat-exchange space above the reflector, high temperatures result in the region of the loading opening, as a result of which it is to be feared that the life-span of the usual seals of the drum can be adversely affected. The direct irradiation of the outer surface of the washing drum causes the latter to be heated as wished, so that towards the end of the drying process, there is a higher temperature in the material of the washing drum. So long as there is still moisture in the washing, this increased temperature is seen to be advantageous. If, however, for example as a result of a fault in the controlling of the machine, the drying-process is not terminated at the correct point in time and the washing is consequently overdried, the danger exists that the washing will suffer damage.

It is therefore desirable to find measures through which provision can be made that on the one hand the temperature of the material of the washing drum does not overstep a certain threshold value, lying in the safe region, these measures being achievable with simple means which will not raise production costs and that on the other hand will not disadvantageously influence the economical operation of the machine.

This problem is solved in accordance with the invention by connecting the heat-exchange space with the washing liquid container by way of circulating-air nozzles at the edge of the reflector, and the circulating-air nozzles serving to conduct circulating-air, blown out of the circulating-air-nozzles, in the form of an air curtain, under a corner obliquely inwards on to the exterior of the washing-drum in such a way that the circulating-air essentially flows into the interior of the washing-drum in the region under the reflector.

These measures serve to ensure, in an advantageous way, that the circulating-air coming out of the heat-exchange space, through the circulating-air-nozzles, builds up an air-cushion under the reflector in the region of the heat-register, which air-cushion is held together by the current-curtain directed against the exterior of the washing-drum in a corner obliquely inwards, so that the dry circulating-air supplied must flow through the perforations of the washing-drum into the region under the heat-register and perforce into the interior of the washing-drum. Through this current-curtain directed under the heat-register, a certain cooling of the exterior of the washing-drum is effected so that, particularly towards the end of the drying process, the danger of overheating is avoided. By the action of the air curtain, it can further be prevented that the essential portions of the supplied dried circulating-air are sucked out from the free-space between the washing liquid container and the washing-drum direct to the drain-opening without the sucked-out circulating-air having loaded itself optimally with moisture in the interior of the washing-drum.

It is indeed already known, from German Gebrauchsmuster No. 66 00 587 and U.S. Pat. Spec. No. 3,040,440, to fit the heat-register is a recess in the washing liquid container and to supply air so as to load itself with moisture through openings in the reflector-sheet. In both cases the supplied air is sucked in from the interior of the washing liquid container through openings in the reflector, so that the danger exists that by-passes will develop along which the air flows directly to the sucking-out opening without loading itself sufficiently with moisture. In contrast to this, the invention provides that the air is encouraged by a suction-pressure-impeller in the form of a turbine which builds up an excess of pressure in the heat-exchange space so that the air emerges at a proportionately higher speed through the circulating-air nozzles and builds up the air curtain already mentioned and therewith the air-cushion between the reflector and the outer surface of the washing-drum. The dried circulating-air from this air cushion, which penetrates through the perforations into the interior of the washing-drum under pressure is subject to a strong turbulence in the interior of the washing-drum and before it is sucked out through the perforations of the washing-drum to the drain-opening, it can saturate itself with moisture.

To guarantee a closed air-cushion, it is provided, in accordance with an advantageous development of the invention, that the circulating-air-nozzles are in the form of slit-nozzles distributed over the entire peripheral region of the reflector. This ensures that the current-curtain not only positively prevents the supplied dried circulating-air from flowing off into the intermediate space between the washing-drum and the washing liquid container, along the exterior of the washing-drum, but also in the regions of the end faces of the drum.

The prevention of the supplied circulating air from flowing-off into the intermediate space between the washing liquid container and the washing-drum is further assisted if the cross-sectional area of the outlets of the circulating-air nozzles is about one-eight to one-twentieth of the cross-sectional area of the perforations in the washing-drum in the region under the recess in which the reflector is disposed. By appropriate selection of this relationship between the cross-sectional areas and the mass of the displaced circulating-air, optimal air-conduction can be achieved, in which moisture loading of the circulating-air to complete saturation is achievable. In this way, the economy of the washing and drying machine is further improved, whereby it is possible to achieve an improvement of the drying capacity of approx. 16% to 20% with a drum-type washing and drying machine according to the invention as compared with a similar prior art machine.

The invention will be described further, by way of example, with reference to the accompanying drawing, in which the single FIGURE is a diagrammatic sectional elevation of a preferred embodiment of the drum-type washing and drying machine in accordance with the invention.

In the drawing, the usual housing of the drum-type washing and drying-machine is not illustrated. A washing liquid container 10 is provided with heat insulation 11 on its outside and has, in its upper part, a recess 12 in which a heat-register or heating element 13 is installed. The heat-register 13 serves for the direct irradiation of a washing-drum 14 situated in the container 10. Within the recess 12 a reflector 18, e.g. of sheet form, is fitted behind the heat register 13, which reflector serves to increase the irradiation-heat given off in the direction of the washing-drum 14. The material of the washing-drum 14 is a good conductor of heat and transmits any heat energy it absorbs to washing accommodated in the interior of the drum 14 primarily by conduction. The outer curved wall of the washing-drum 14 is perforated in the usual way.

Fitted in the bottom of the washing liquid container 10 is a drain-opening 15 through which the washing liquid and rinsewater can be led away during the washing process by means of a pump 16. A drain-channel 17 connects directly with the drain-opening which channel 17 includes a turbulence section 20 and a quietening section or becalming section 21. In advance of the turbulence section 20, a spray-nozzle 22 opens into the drain channel 17, through which nozzle 22 cold water is sprayed, as a water-spray, into the turbulence section 20 through a conduit 23.

Between the turbulence section 20 and the quietening-section 21, a slub-filter 25 is fitted in a slub-filter-compartment 24. This slub-filter-compartment 24 is enlarged in the transverse section and contributes to quietening of the current and to precipitation of condensed liquid.

The lower end of the pipe of the quietening section 21 is connected with a circulating-air-conduit 26 which leads upwards to an impeller which is preferably a two-stage suction-pressure turbine 27. From this suction-pressure turbine 27 an air-channel extends to heat-exchange space 30 which is present behind the reflector 18 in the recess 12. Between the reflector 18 and the wall of the washing liquid container 10 there are fitted circulating-air nozzle 31 which can have the form of slit-nozzles and extend essentially over the entire peripheral region of the reflector 18. These circulating-air nozzles 31 are so designed that circulating-air emerging therefrom at high speed forms an air curtain which, being obliquely inclined inwards, extends to the washing-drum 14 and prevents essential portions of the supplied circulating-air from escaping at the side. Thus a damming-up of air occurs in the recess 12 from which the air only flows off into the interior of the washing-drum 14 through the perforations in the section of the outer curved surface of the washing-drum 14 which lies opposite the heat-register 13. By suitably guiding the air curtain so that the air striking the upper surface of the exterior of the washing-drum 14 is deflected each time in a direction under the heat-register 13, it can be provided that essentially none of the supplied dried circulating-air flows in the intermediate space between the washing liquid container 10 and the washing-drum 14 directly to the drain-opening 15 and thereby spoils the degree of effectiveness of the drying-process.

/The air streaming through the heat-exchange space 30 is already somewhat warmed at the back side of the reflector 18 so that the dried air becomes more absorbent of water vapour. When flowing out through the circulating-air nozzles 31, the circulating-air undergoes an unimportant decrease in pressure so that when it strikes the outer surface of the washing-drum 14 a slight cooling effect results and overheating of the washing-drum is prevented even when the washing is already dry.

With a drum-type washing and drying machine built in accordance with the invention a ratio of 1:8 to 1:20, preferably 1:12 for the cross-sectional area of the air nozzles in comparison with the cross-sectional area of the perforations of the washing-drum is chosen. With a proportion of 1:12, circulated air-mass of 12 $m^3$/min an improvement of the drying capacity, with the same requirements of electricity, of about 16% to 20% resulted in comparison with the most economical drum-type washing and drying machines known at the present time.

Condensed water and cooling water which collect in the quietening-section 21 of the drain-channel 17 is supplied by a water pump 16 through an entrainment nozzle or pump 33 which pump 33 pumps water out through a drain 34.

By use of the measures of the invention it is possible to fashion the circulating-air-conduit constructively very simply so that not only an improvement in capacity results but also a cheapening of production.

The equipment described above in accordance with the invention for a drum-type washing and drying-machine can also be used as a dryer only, with the achievement of the same advantages.

I claim:

1. A drum-type washing and drying machine having a heating element fitted in the upper part of a washing liquid container in a recess in front of a reflector so as to provide for direct irradiation of a washing-drum mounted within the container; a circulating-air conduit extending between a drain-opening in the bottom of the container and a heat exchange space situated above said reflector, said circulating air conduit including a suction-pressure-impeller, the pressure side of which opens into said heat-exchange space; a condenser adapted to be supplied with cold water; said heat-exchange space being connected with the washing liquid container by way of circulating-air nozzles at the edge of the reflector, said nozzles serving to conduct circulating-air in the form of an air curtain obliquely inwards onto the exterior of the washing-drum in such a way that the circulating-air essentially flows into the interior of the washing-drum in the region under the reflector.

2. A drum-type washing and drying machine as claimed in claim 1 characterised in that the circulating-air nozzles are in the form of slit-nozzles distributed over the entire peripheral region of the reflector.

3. A drum-type washing and drying machine as claimed in claim 1 or 2 characterised in that the cross-sectional area of the outlets of the circulating-air nozzles is approximately one-eight to one-twentieth of the cross-sectional area of the perforations in the washing-drum in the region under the recess in which the reflector is disposed.

4. A drum-type washing and drying machine including a washing container provided with a recess in the upper part thereof and a drain opening in the lower portion thereof, a drum rotatably mounted in said washing container, a heating element fitted in said recess, a reflector positioned between said heating element and the top of said recess and spaced from each to direct radiation toward said drum, a circulating-air conduit for connecting said drain-opening with a heat-exchange space defined between said reflector and the recess, condenser means within said circulating air means for condensing moisture from the circulating air, means defining circulating-air nozzles for connecting said heat-exchange space with the washing container, said nozzles being positioned at the edge of said reflector so that circulating air is emitted therefrom in the form of an air curtain so that an air cushion is formed within said curtain, said curtain being directed obliquely inwards onto the exterior of said drum in such a way that the circulating-air essentially flows into the interior of said drum in the region under the reflector.

5. A rotating drum-type clothes washer and dryer including a housing, a liquid container mounted within said housing, a drum having perforated sidewalls rotatably mounted within said container, said container including means defining a recess in the upper portion thereof opening toward said drum, air circulation means for circulating air from the lower portion of said container to said recess, reflector means positioned within said recess and above said drum so as to define together with said recess a chamber therebetween, heater means positioned between said reflector means and said drum for providing a drying atmosphere, said reflector means further including means defining nozzles about the periphery of said chamber so that air from said air circulation means flows into said chamber and out said nozzles in the form of a curtain and in a direction obliquely inwardly toward said drum so that said air curtain creates an air cushion beneath said reflector means and about said heating means and causes the circulating air to flow into said drum substantially from within the region beneath said reflector.

6. A washer-dryer as in claim 5 wherein the air curtain flows exteriorly about said heater means.

* * * * *